United States Patent [19]

Mohlenbrock

[11] 4,353,566

[45] Oct. 12, 1982

[54] ROLLER SKI TRAINING DEVICE

[76] Inventor: William Mohlenbrock, Box 1711, Rancho Santa Fe, Calif. 92067

[21] Appl. No.: 111,366

[22] Filed: Jan. 11, 1980

[51] Int. Cl.[3] ..... A63C 17/26

[52] U.S. Cl. ..... 280/87.04 A; 280/11.1 BT; 280/11.28

[58] Field of Search ..... 280/11.1 BT, 87.04 A, 280/87.04 R, 607, 818, 21 A, 16, 17, 15, 12 H, 11.28, 11.27, 11.19; 272/97

[56] References Cited

U.S. PATENT DOCUMENTS

| | | | |
|---|---|---|---|
| 2,025,858 | 12/1935 | Harris | 280/11.28 X |
| 2,510,722 | 6/1950 | Snyder | 280/11.28 |
| 4,133,546 | 1/1979 | Rosenblum | 280/11.1 BT |
| 4,134,600 | 1/1979 | McDonald et al. | 280/11.1 BT X |

FOREIGN PATENT DOCUMENTS

| | | | |
|---|---|---|---|
| 446984 | 5/1968 | Switzerland | 280/87.04 A |

*Primary Examiner*—Joseph F. Peters, Jr.
*Assistant Examiner*—Milton L. Smith
*Attorney, Agent, or Firm*—Leydig, Voit, Osann, Mayer & Holt, Ltd.

[57] ABSTRACT

A roller ski training device which effectively simulates weighting, unweighting, and edging techniques of the downhill parallel snow skiing. The device includes a support frame, a pair of parallel elongated foot plates pivotally carried in side by side relation by said support frame, and rollers flexibly coupled to the underside of the support frame whereby the shifting of weight by a user to the foot plate on one side of the device tends to cause the device to turn in the direction of the other side. The flexible roller coupling further permits tilting of the frame, with the resultant raising and lowering of the foot plates, in response to the shifting of weight from one foot plate to the other. Parallel linkage is connected to the underside of the foot plates to synchronize pivotal and vertical positioning of the foot plates such as to maintain them in parallel planes at all times. In one embodiment, the foot plates are further supported for limited longitudinal movement with respect to the support frame and each other.

13 Claims, 12 Drawing Figures

FIG. 1
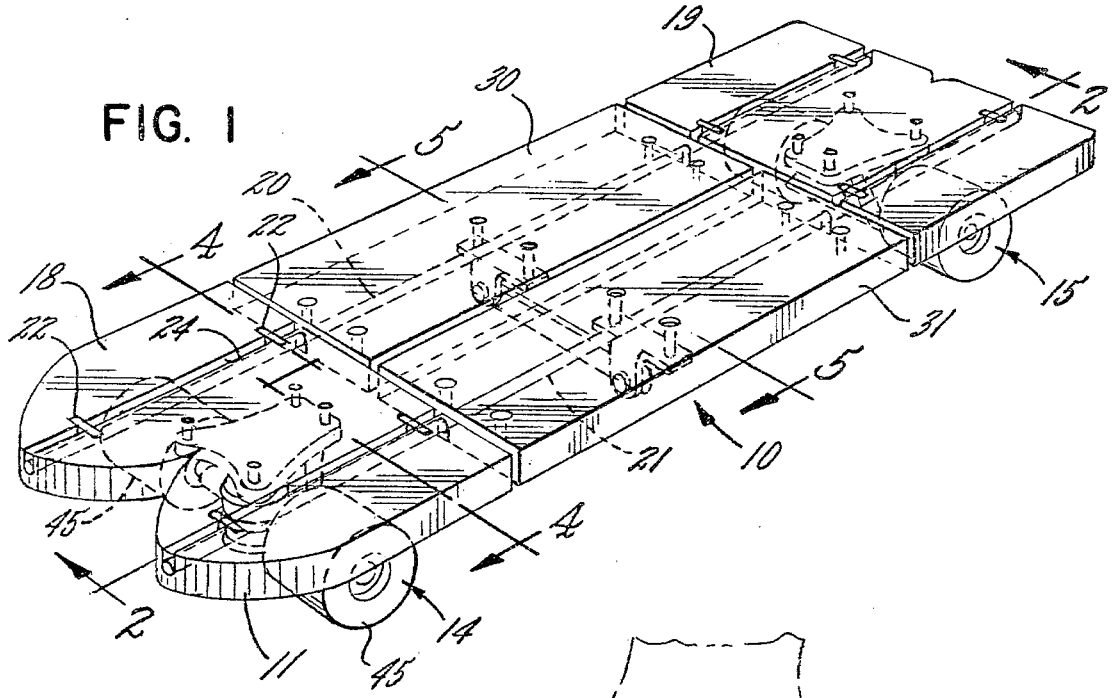
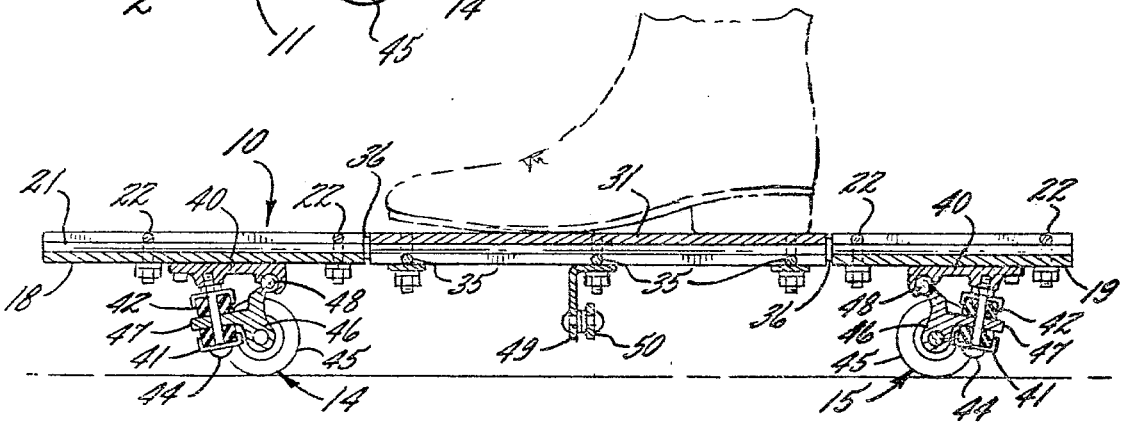
FIG. 2
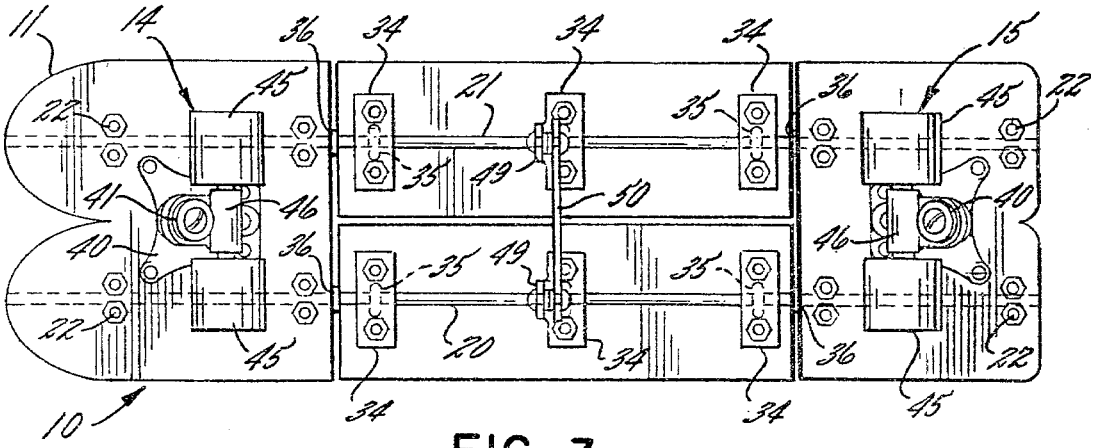
FIG. 3

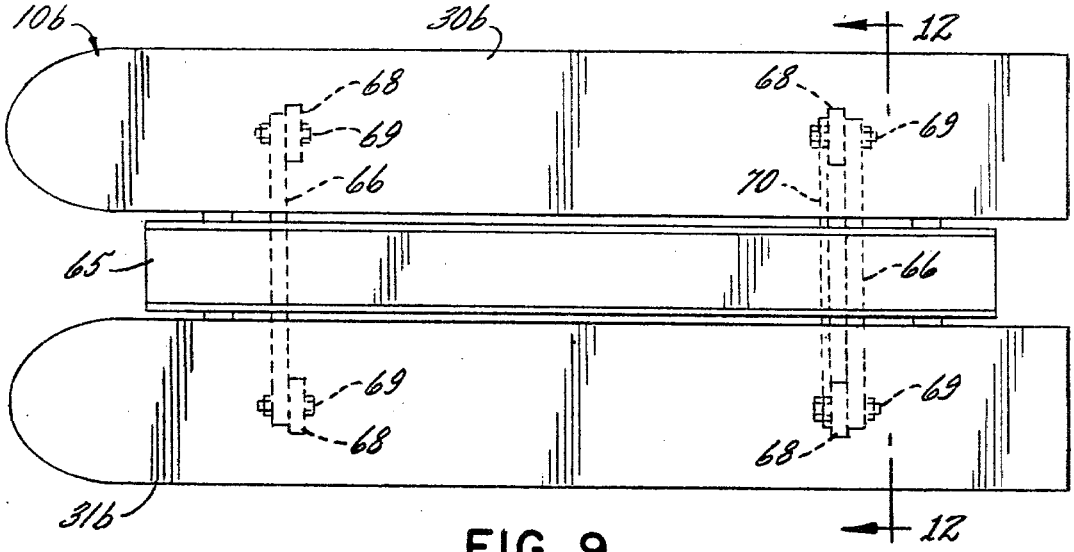
FIG. 9
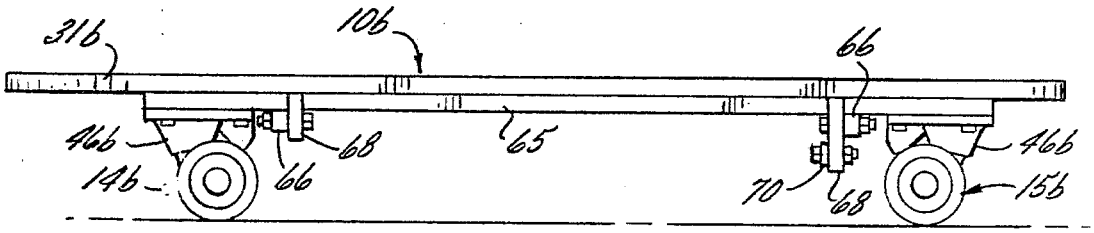
FIG. 10
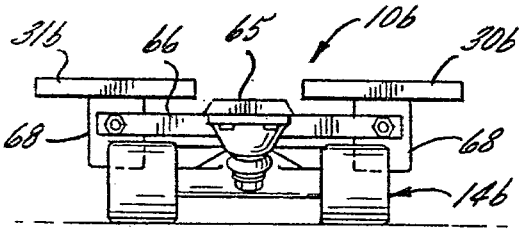
FIG. 11
FIG. 12
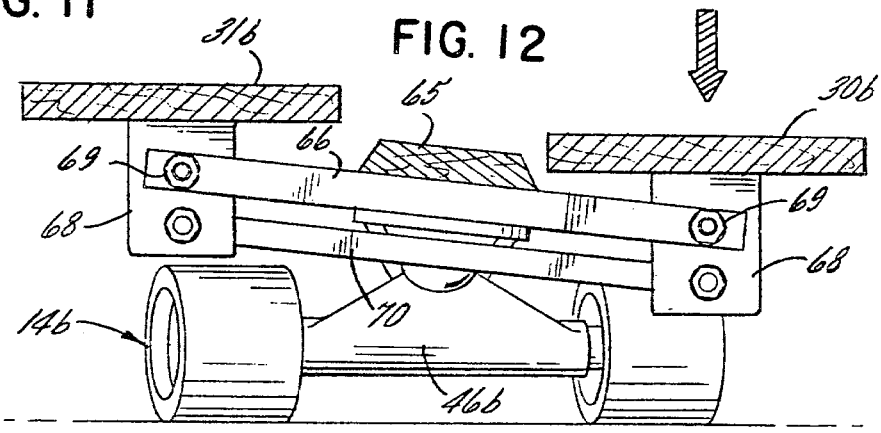

ROLLER SKI TRAINING DEVICE

DESCRIPTION OF THE INVENTION

The present invention relates generally to wheeled recreational devices, and more particularly, to a roller stateboard type device for simulating downhill snow skiing.

In the past, snow skiers have found it difficult to regularly practice skiing techniques since the ski season is usually limited to a few winter months and the skier generally must travel to an established ski area which may not be conveniently located. Although the common skateboard, as well as other roller devices heretofore proposed for ski training, require a sense of balance for proper use, such devices do not provide the feeling of weighting, unweighting, and balance associated with parallel skiing. In such prior devices, for example, to effect a turn, the user generally must shift his weight to the side or direction in which he wishes to turn. Such weight transfer, however, is directly opposite from that used by downhill skiers for changing their direction of travel. Hence, such prior roller devices have been of limited usefulness as training devices for downhill skiers.

It is an object of the present invention to provide an improved roller device which effectively simulates parallel skiing techniques, and thereby, enables the skier to learn and improve such techniques by practice on a regular basis without the necessity for traveling to a ski area.

Another object is to provide a roller ski training device as characterized above which truly simulates weighting, unweighting, and edging techniques that are essential in parallel snow skiing.

A further object is to provide a roller ski training device of the above kind that enables snow skiers to improve parallel snow skiing techniques, as well as condition and coordinate muscle groups of their body that are affected during skiing.

Still another object is to provide a roller ski device of the foregoing type that is relatively simple in construction and use, and is economical to produce.

Other objects and advantages will become apparent as the foregoing description proceeds taken in conjunction with the accompanying drawings, in which:

FIG. 1 is a perspective view of a roller ski training device embodying the present invention;

FIG. 2 is a vertical section taken in the plane of line 2—2 in FIG. 1;

FIG. 3 is a bottom view of the device shown in FIG. 1;

FIG. 9 is a top plan view of a second alternative embodiment of roller device embodying the present invention;

FIG. 10 is a side elevational view of the device shown in FIG. 9;

FIG. 11 is a front elevational view of the device shown in FIG. 9; and

FIG. 12 is an enlarged fragmentary section taken in the plane of line 12—12 in FIG. 9, showing the action of the foot plates as weight is shifted to the right side.

Figure 4:
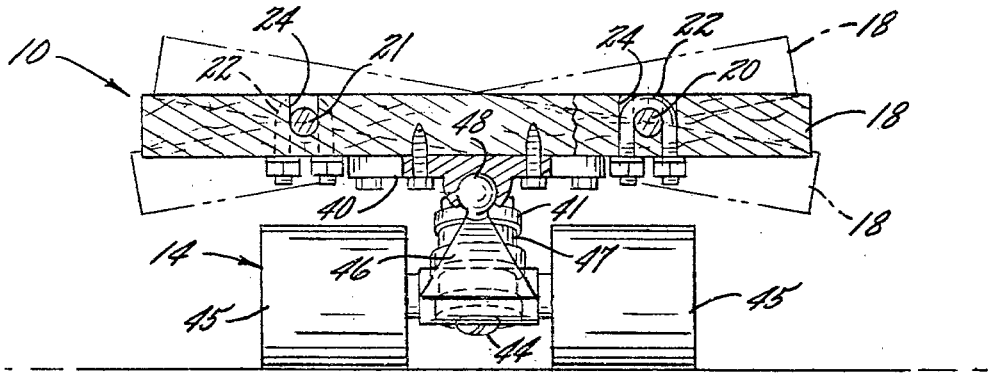
FIG. 4 is an enlarged section taken in the plane of line 4–4 in FIG. 1, and showing ranges of movement of the foot plates thereof in phantom.

While the invention is susceptible of various modifications and alternate constructions, certain illustrated embodiments thereof have been shown in the drawings and will be described in detail. It should be understood, however, that there is no intention to limit the invention to the specific forms disclosed, but on the contrary, the intention is to cover all modifications, alternate contructions and equivalents falling within the spirit and scope of the invention.

Referring more particularly to the drawings, there is shown an illustrative roller ski training device 10 embodying the present invention. The roller device 10 includes a frame or support 11 which is carried by front and rear roller assemblies 14, 15 for rolling movement. The frame 11 in this case comprises front and rear base plates 18, 19 that are held in longitudinally spaced relation by a pair of parallel elongated support rods 20, 21. The support rods 20, 21 in this instance extend the entire length of the roller device 10 and are rigidly secured to the front and rear base plates 18, 19 by a plurality of U-bolts 22 which each are mounted in depending fashion with fastening nuts on the under side of the base plates. In order that the support rods 20, 21 are disposed below the upper surface of the base plates 18, 19, the base plates are formed with longitudinal grooves 24 for receiving the rods. The U-bolts similarly are recessed below the upper surface of the base plates.

For supporting a user of the device in a manner similar to that in which a skier stands on skis, the device 10 includes a pair of longitudinally disposed foot plates 30, 31 that are pivotally mounted in parallel side by side relation on the elongated support rods 20, 21. In this instance, each foot plate is formed with a central longitudinal groove 32 which is positionable on a respective one of the support rods. To captively hold the foot plates 30, 31 on the support rods while permitting relative pivotable movement thereof, transverse brackets 34 are secured to the underside of the foot plates at longitudinally spaced location. To facilitate pivotal movement of the foot plate relative to the rod and minimize undesirable play, bushings 35 are provided about the support rod at the location of each bracket and bushings 36 are located at the ends of the foot plates.

Figure 6:
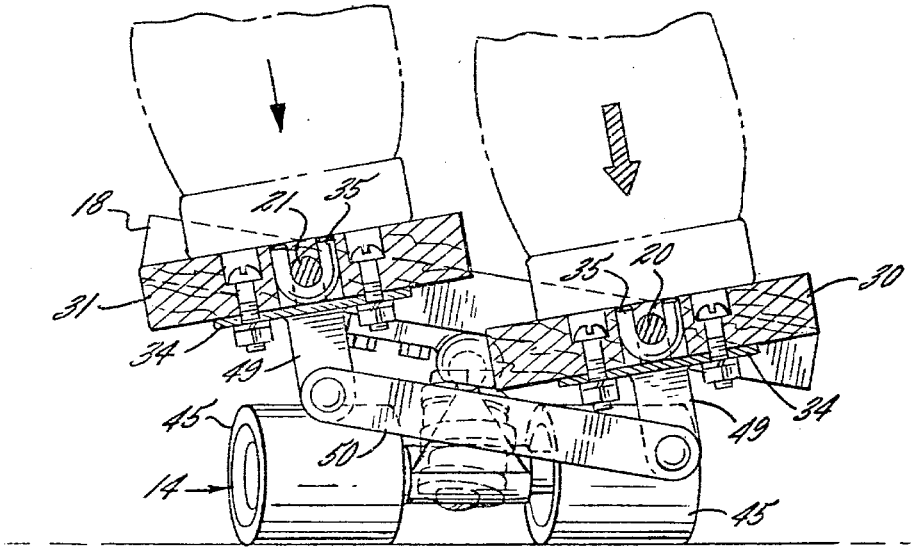

In accordance with the invention, the roller device is adapted to respond to weighting and unweighting of a respective foot plate by a user in a manner which closely simulates the action of skis during parallel skiing. More specifically, shifting of weight toward one foot plate tends to cause the device to turn in the opposite direction, with the foot plates being free to move to different vertical levels while being maintained in parallel planes. To this end, the roller assemblies 14, 15 flexibly support the base plates 18, 19 such as to permit tilting movement of the base plates upon shifting of weight toward one side, which in turn, tends to reorient the wheel assemblies so as to turn the device in the opposite direction, such as seen in FIG. 6.

The roller assemblies 14, 15, which may be of a commercially available type commonly used in skateboards, in this instance each includes a mounting plate 40 secured to the underside of a respective one of the base plates 18, 19 and a flexible connector 41 depending from the mounting plate 40 at an acute angle with respect to the base plate. The flexible connector 41 in this case is in the form of a rubber sleeve 42 which is held by a bolt 44 threadedly engaging the mounting plate 40. Each roller assembly 14, 15 further includes a pair of transversally spaced rollers 45 rotatably carried by a mount 46 that includes a collar 47 secured about the rubber sleeve 42 and a pivot extension 48 secured to the underside of the base plate 40 for limited pivotal movement.

Although the roller assemblies 14, 15 are of a commercially available type, it will be appreciated that the assemblies are mounted in an opposite fashion than employed on conventional skateboards. The front wheel assembly is mounted such that the flexible connector 41 is disposed in a downward and rearward direction, with the rollers 45 located behind the connector 41 and slightly in front of the pivot point of the mount 46. With such a flexible base plate support, when weight is shifted to the right foot plate 30, the base plate 18 will tilt to the right, and this in turn, by virtue of the angled mounting, will cause the rollers 45 of the front wheel assembly to turn in the opposite direction, such as seen in FIG. 6.

The rear wheel assembly 15, on the other hand, is mounted with the rollers forwardly of the inclined flexible connector 41. Tilting of the base plate 19 in this case, upon a weight shift to the right side, tends to turn the rollers to the right which facilitates directing the rear of the device about a turn in the opposite direction. It will be seen that such tilting of the base plates 18, 19 upon shifting of weight from one side to the other, not only changes orientation of the rollers and direction of travel of the device, but also permits the foot plates 30, 31 to experience limited relative vertical movement with respect to each other, such as occurs with skis when turning or traversing on a slope. During such relative vertical movement of the foot plates, it can be seen that the foot plates pivot on their respective support rods 20, 21.

In keeping with the invention, means are provided for synchronizing the pivotal and vertical movements of the foot plates 20, 21 during such weight shifting so that the foot plates are maintained in parallel planes. For this purpose, in the illustrated embodiment adjacent brackets 34 on the underside of the foot plates 30, 31 each are formed with a depending flange 49 which in turn are connected together by a link 50 disposed in parallel relation to the foot plates. Such parallel linkage, as seen in FIGS. 4–6, coordinates tilting movement of the foot plates relative to the support rods and assures that they also are maintained in parallel planes.

Figure 5:
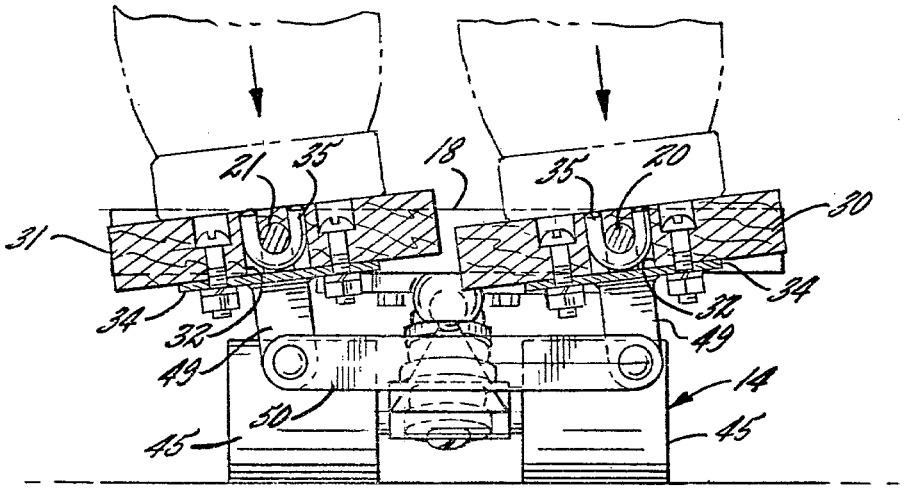
FIGS. 5 and 6 are enlarged sections taken in the plane of line 5—5 in FIG. 1, but showing the action of the footplates as the user shifts his weight to the right side.

In use of the roller ski training device 10 on an inclined surface, such as a sloped driveway, road, walkway or the like, it will be seen that when the user has his weight equally distributed on the foot plates 30, 31 such that base plates 18, 19 are in substantially perpendicular relation to the wheel assemblies 14, 15 as shown in FIG. 4, the device will proceed in a straight direction. When the user shifts his weight to the right side, as shown in FIGS. 5 and 6, the base plates 18, 19 tend to be tilted to the right lowering the right foot plate 30 relative to the left and causing the device 10 to turn to the left, just as would occur during skiing. Likewise, upon shifting the weight to the left foot plate 31, the base members 18, 19 are tilted to the left, causing the left foot plate 31 to be gradually lowered relative to the right and the orientation of the rollers 45 changed so as to turn the device toward the right. Thus, by shifting the weight between the right and left foot plates, the user may traverse down inclined surfaces with movements that effectively simulate the weighting, upweighting and balance conditions of parallel snow skiing.

Moreover, during such weight shifting, the connecting linkage 49, 50 between the foot plates 30, 31 synchronizes the pivotal and relative vertical positioning of the foot plates such that they are maintained in substantially parallel planes. The effect of this is not only to insure coordination and control of the foot supporting members, as is essential in snow skiing, but also provide the user with a sensation of being able to direct his weight toward the appropriate longitudinal edges of the foot plates in a manner similar to edging techniques necessary for controlling skis during downhill skiing. Thus, the roller device 10 can be highly useful for either learning or perfecting such parallel ski techniques. And, just as in parallel skiing, as one perfects the rhythm and balance associated with turning and traversing down inclines, the roller device 10 may be used on steeper sloped surfaces for faster operation, greater excitement, and the development of more expert parallel skiing techniques.

Figure 7:
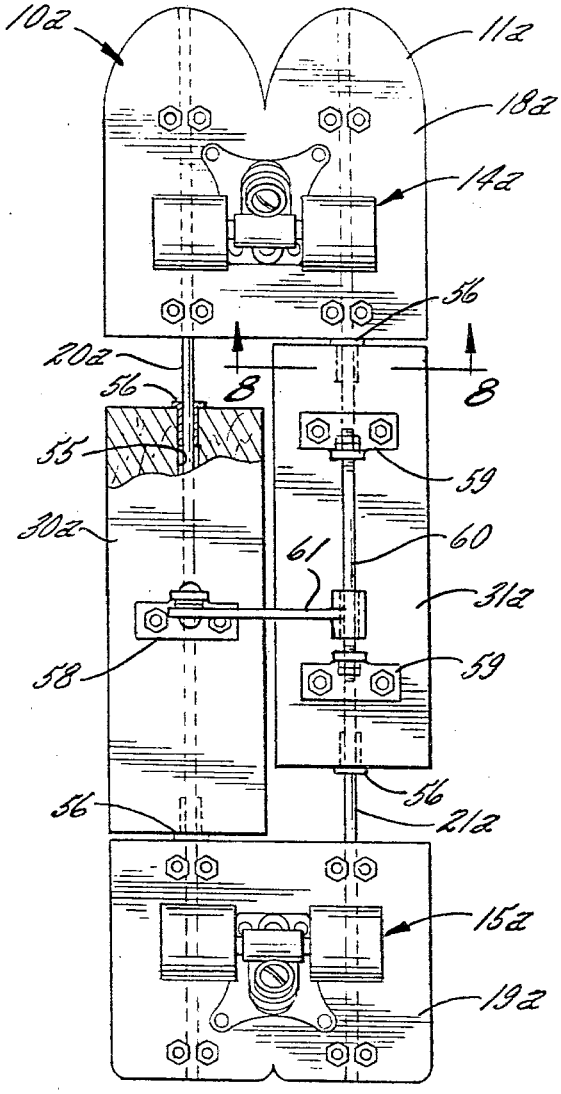
FIG. 7 is a bottom view of an alternative embodiment of roller ski training device embodying the present invention.
Figure 8:
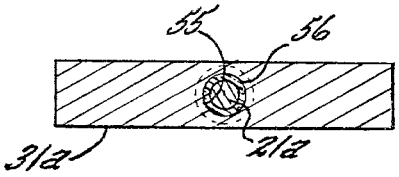
FIG. 8 is an enlarged fragmentary section taken in the plane of line 8—8 in FIG. 7.

Referring now to FIGS. 7 and 8, there is shown an alternative embodiment of the invention in which the foot plates are further adapted for limited relative longitudinal movement. In this embodiment, parts similar to those previously described have been assigned similar reference numerals with the distinguishing suffix "a" added. It will be seen that the ski training device **10*a* similarly includes front and rear base plates 18*a*, 19*a* interconnected by longitudinal rods 20*a*, 21*a* and supported for rolling movement by roller assemblies 14*a*, 15*a* identical to those previously described. A pair of adjacent foot plates 30*a*, 31*a*are pivotally mounted on the respective support rods 20*a*, 21*a* for both relative pivotal and longitudinal movement. The foot plates in this case each are formed with a central longitudinal bore 55 through which the respective support rod 20*a*, 21*a* is passed. To facilitate axial and pivotal movement of the foot plates on the support rods, bushings 56** are provided at opposite ends of the foot plates.

Parallel linkage in this case is connected between the undersides of the foot plates **30*a*, 31*a* to synchronize the pivotal movement of the foot plates while permitting selected relative longitudinal movement. In the illustrated embodiment, one of the foot plates has a single depending bracket 58 and the other foot plate has a pair of longitudinally spaced depending brackets 59 which carry a pivot rod 60. A crosslink 61 is pivotally connected at one end to the bracket 58 and its other end is connected to the rod 60** for relative pivotal and longitudinal movement.

It will be understood by one skilled in the art that it is common for a snow skier to maintain one ski, usually the uphill ski, several inches in front of the other ski in order to prevent the ski tips from crossing. In use of the roller device **10*a***, it can be seen that the technique of controlling such relative longitudinal positioning of foot plates can be practiced, together with the same weighting, upweighting and turning techniques previously described.

Referring now to FIGS. 9–12, still another alternative embodiment of roller ski training device is shown wherein items similar to those described above have been given similar reference numerals with the distinguishing suffix "b" added. The ski training device **10*b*** includes a support frame comprising a central longitudinal member 65 supported for rolling movement by front and rear roller assemblies 14*b*, 15*b* in the same manner described above. A pair of parallel foot plates 30*b*, 31*b* in this case are mounted for pivotal and vertical movements at the ends of supports 66 mounted transversally of the longitudinal member 65. Each of the foot plates includes depending mounting flanges 68 that are pivotally connected to the ends of the support members 66, such as by bolts 69. To coordinate movement of the foot plates relative to the transverse support member, a crosslink 70 is coupled between the lower ends of the flanges 68. The device 10*b* can be used to simulate the same parallel ski techniques are described with respect to the roller device 10. When a user shifts his weight to one foot plate, such as the right foot plate 30*b* shown in FIG. 12, the flexible roller assemblies 14*b*, 15*b* permit the transverse frame supports 66 to be tilted to the right as illustrated, which in turn alters the vertical positioning of the foot plates 30*b*, 31*b* and reorients the rollers 45 such as to turn the device in the opposite direction.

In view of the foregoing, it can be seen that the ski training device of the present invention is adapted to effectively simulate parallel skiing techniques and thereby enable skiers to learn and improve such techniques by practice on a regular basis on inclined driveways, roads and the like, without the necessity for traveling to ski areas. It will be appreciated that the illustrated ski training device not only enables skiers to practice weighting, unweighting and edging techniques that are essential in parallel skiing, but also provides a means for conditioning and coordinating muscle groups that are affected during skiing. The ski training device of the present invention also is relatively simple in construction and use, and economical to produce.

I claim as follows:

1. A roller ski training device comprising support means, a pair of parallel foot plates upon which a user may stand pivotally carried in side by side relation by said support means, front and rear roller means for carrying said support means for rolling movement, and means for coupling said roller means to said support means and for causing the device to turn in the direction of one side in response to shifting of weight by the user to the foot plate of the other side.

2. The roller ski training device of claim 1 in which said coupling means is flexible for permitting tilting movement of said support means and raising and lowering of said foot plates in response to shifting of weight from one foot plate to the other.

3. The roller ski training device of claim 2 in which said flexible coupling means is responsive to the lowering of a foot plate on one side for turning said forward roller means toward the opposite side.

4. The roller ski training device of claim 2 in which said foot plates are pivotal relative to said support means during said raising and lowering movement, and means for synchronizing such pivotal foot plate movement so that said foot plates are maintained in parallel planes.

5. The roller ski training device of claim 4 in which said means for synchronizing pivotal movement of said foot plates includes linkage connected between the undersides of said foot plates.

6. The roller ski training device of claim 5 in which said linkage includes a flange depending from the underside of each foot plate, and a link connecting said foot plate flanges.

7. The roller ski training device of claim 1 in which said support means carry said foot plates for limited longitudinal movement with respect to said support means and each other.

8. The roller ski training device of claim 1 in said support means includes front and rear base members and a pair of parallel elongated rods connecting said base members, and said foot plates each being pivotally mounted upon one of said elongated rods.

9. The roller ski training device of claim 1 in which said support means includes a central longitudinal member supported at opposite ends by said roller means, and transverse members extending outwardly from said central longitudinal member for pivotally supporting said foot plates on opposite sides of said longitudinal member.

10. A roller ski training device comprising support means, a pair of parallel foot plates pivotally carried in side by side relation by said support means, roller means carrying said support means for rolling movement, and flexible connecting means coupling said roller means to said support means for permitting raising and lowering of said foot plates in response to the shifting of weight by a user from the foot plate on one side of said device to the foot plate on the other side and for causing the device to turn in the direction of one side in response to shifting of weight by the user to the foot plate of the other side.

11. The ski training device of claim 10 in which said support means is tiltable from one side to the other in response to shifting of weight on said foot plates, and said foot plates being pivotal relative to said support means during such tilting movement.

12. The ski training device of claim 11 including means for synchronizing pivotal movement of said foot plates such that they are maintained in parallel planes during tilting of said support means.

13. The roller ski training device of claim 10 in which said roller means are disposed at forward and rearward ends of said support means, and said flexible roller connecting means is responsive to the lowering of a foot plate on one side for turning said front roller means toward the opposite side.

* * * * *